US006209229B1

(12) United States Patent
Bourdeau

(10) Patent No.: US 6,209,229 B1
(45) Date of Patent: Apr. 3, 2001

(54) SNOWBOARD BOOT INCLUDING AN INTERNAL SHELL AND A JOURNALLED RIGID BACK PORTION

(75) Inventor: Joel Bourdeau, Saint Jorioz (FR)

(73) Assignee: Salomon S.A., Metz-Tessy (FR)

( * ) Notice: Subject to any disclaimer, the term of this patent is extended or adjusted under 35 U.S.C. 154(b) by 854 days.

(21) Appl. No.: 08/676,928

(22) Filed: Jul. 8, 1996

(30) Foreign Application Priority Data

Jul. 11, 1995 (FR) ..... 95 08587

(51) Int. Cl.[7] ..... A43B 5/00
(52) U.S. Cl. ..... 36/117.1; 36/118.9
(58) Field of Search ..... 36/115, 116, 117.1, 36/118.9, 119.1

(56) References Cited

U.S. PATENT DOCUMENTS 5,401,041 * 3/1995 Jespersen ..... 280/14.2
5,435,080 * 7/1995 Meiselman ..... 36/117.1
5,437,466 * 8/1995 Melbock et al. ..... 36/115
5,499,461 * 3/1996 Danezin et al. ..... 36/117.1

FOREIGN PATENT DOCUMENTS 3622746 1/1988 (DE) .
0646334 4/1995 (EP) .
406178701 * 6/1994 (JP) ..... 36/118.2

* cited by examiner

*Primary Examiner*—M. D. Patterson
(74) *Attorney, Agent, or Firm*—Greenblum & Bernstein P.L.C.

(57) ABSTRACT

The invention relates to a snowboard boot including a sole adapted to be attached to the board, a relatively flexible upper, mainly forming the outer portion of the boot and connected to the sole, a rigid shell at least partially covering the sole and extending upwardly at the rear of the boot, at the level of the heel, and a rigid back portion journalled on the shell and extending it upwardly. The rigid back portion is journalled on the internal side of the boot, along a journal axis forming an angle of inclination between 20 and 45° with respect to the median longitudinal plane of the boot. Such an improved boot maintains its qualities of comfort while ensuring the transmission of the forces that are essential for a good control and mastery of the board in the sports involved.

15 Claims, 7 Drawing Sheets

SNOWBOARD BOOT INCLUDING AN INTERNAL SHELL AND A JOURNALLED RIGID BACK PORTION

BACKGROUND OF THE INVENTION

1. Field of the Invention

The present invention relates to a snowboard boot, especially of the flexible type particularly adapted for practicing sports such as the "free ride" or "free style."

2. Background and Material Information

Currently, flexible-type boots are essentially designed as mere upwardly extending, impervious and comfortable shoes, but having no actual role in the transmission of forces.

They must be adapted to retaining devices shaped like an open shell having an upwardly extending rear element and a sufficient number of straps to ensure the tightening of the boot to the device. The rear element must be rigid to ensure the rearward support in the so-called "back side" turns. These assemblies have numerous disadvantages. They are very cumbersome due to the straps and the upwardly extending rear support. The straps must be readjusted upon each re-engagement of the shoe in the shell after each climb. The tightening of the straps must be sufficient to retain the boot on the board, which often causes painful constriction spots for the foot in view of the flexibility of the upper. Finally, these shells poorly transmit the bending stresses in all directions, including in rear support, due to an often imprecise adaptation of the rear element to the boot.

The snowboarder who practices the new forms of sport is lead to take supports and adopt a substantially prone forward or rearward posture on the road. He must then strongly bend one of his legs inwardly, in the direction along which a knee is brought closer to the board. The other leg is also subject to a less substantial outward lateral inclination. To facilitate the inward bending of the leg, while maintaining a certain balance, the snowboarder can fold the knee, which generates a rear-to-front bending of the lower the leg.

The document EP-A1-646334 relates to a snowboard boot that includes a flexible inner portion in the form of a shoe, an outer portion also in the form of a shoe, with a flexible upper and a rigid insert arranged between these two portions, a rigid back portion that surrounds the calf being journalled on such insert, at the level of the joint of the foot and of the lower leg, along an axis passing through the longitudinal plane of the shoe.

This shoe has the advantage of making it easy to take the "back side" turns in a very efficient manner due to the rigid back portion inserted directly in the shoe while maintaining a certain lateral looseness, regardless of the interior or medial or exterior or lateral side, to enable the snowboarder to adopt more or less bent positions of the legs. The shoe also maintains the comfort of a flexible-type boot by means of an internal liner and of an external flexible upper. This comfort is particularly appreciated during the use of the shoe for walking. But such a shoe still uses a "shell"-type binding with tightening straps whose disadvantages have been cited hereinabove.

In addition, the shoe according to this invention also have disadvantages that are important factors of dissatisfaction and limit the use thereof. In particular, in view of the position of the journal axis in the median longitudinal plane, only the lateral bending of the leg is actually taken into account. The component of natural forward bending of the lower leg is not particularly favored in view of the rigidity of the insert.

The joint where all the forces and stresses are concentrated is located along the Achilles tendon, which creates a painful spot that is very prejudicial to the comfort of the shoe. The tendon is all the more biased when the snowboarder is in rear support, because the lower portion of the rigid back portion exerts a pressure on the shell toward the interior of the heel under the joint by the effect of the lever.

The problem of comfort generated is increased by the choice of an internal construction of the insert and of the rigid back portion in the immediate vicinity of the foot.

Furthermore, the solution according to the application No. EP-A1-646334 does not provide the necessary external lateral support when the surfer is in the position to rebound his board or in the skating phase, when one of his feet is separated from his board.

SUMMARY OF THE INVENTION

The present invention aims at providing a particular satisfactory solution to all of the problems encountered with the previously mentioned prior art solutions. In particular, the invention aims at proposing a boot of the flexible type that maintains its qualities of comfort in any conditions of use, while ensuring the transmission of the forces that are essential to a good control and mastery of the board in the forms of sport involved.

Another object of the invention is to propose a boot which really takes into account the natural movements of internal and external bending of each leg through an appropriate asymmetrical solution.

Another object of the invention is to propose a boot that integrates the essential tightening means by thus separating the tightening function and the retaining function on the board, so as to avoid the disadvantages of the conventional shell systems.

To this end, the invention relates to a snowboard boot including a sole adapted to be attached to the board, a relatively flexible upper, mainly forming the outer portion of the boot and connected to the sole, a rigid shell at least partially covering the sole and extending upwardly at the rear of the boot, in the heed area, and a rigid back portion journalled on the shell and extending it upwardly. The rigid back portion is journalled on the inner side of the boot, along a journal axis forming an angle of inclination comprised between 20 and 45° with respect to the median longitudinal plane of the boot.

Thus localised, the joint is morphologically located in a recessed area between the internal malleolus and the Achilles tendon. During rear supports, the back portion can become deformed inwardly without creating any pain.

A more reduced range can be conceived to address the most commonly encountered situations, as a function of the position of the feet on the board. Thus, the angle of inclination of the journal axis is comprised between 25 and 35°, preferably close to 30°, with respect to the median longitudinal plane.

According to another characteristic, the journal axis is oriented from rear-to-front and from top to bottom, thus taking into account the slightly inclined forward position of the leg, at rest, on the board.

Other complementary characteristics participate in improving the retention and tightening of the foot within the boot. Thus, the shell can include lateral edges that extend upwardly and are adapted to bind the foot on each side, from a base that covers the sole at least partially. Likewise, the boot can include a strap for tightening the instep that connects each lateral edge of the shell.

The direct linkage of the strap on the shell enables a more efficient tightening while preserving the comfort of the foot.

BRIEF DESCRIPTION OF DRAWINGS

Other characteristics and advantages of the invention will become apparent from the description that follows, with reference to the annexed drawings which illustrate, by way of a non-limiting example, the embodiment of the invention, and in which.

DETAILED DESCRIPTION OF THE PREFERRED EMBODIMENTS

Figure 1A:
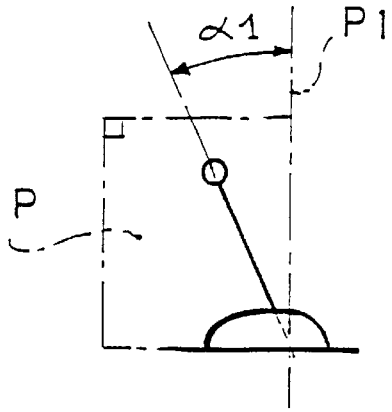
FIG. 1A is a side view of the joint of the lower leg along the longitudinal axis of the snowboard.
Figure 1:
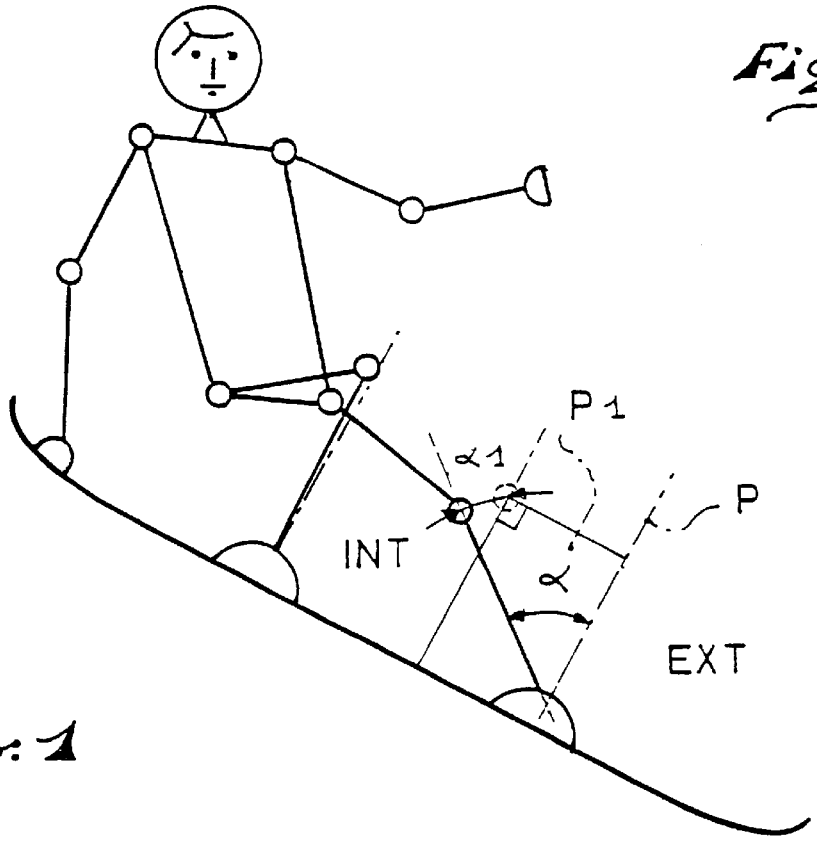
FIG. 1 schematically shows the position of a snowboarder during the normal practice of the sport.

FIG. 1 shows the flexional natural position frequently adopted by a snowboarder. Both feet are fixed to the board along a substantially transverse orientation with respect to the longitudinal axis of the board. The leg that bends on the interior or medial side (INT) is further inclined than the leg that bends on the external side (EXT).

The bending of the lower leg occurs both laterally and frontwardly in view of the joint of the knee. In the maximum bent position, the lower leg has a first component of lateral inclination $\alpha$ with respect to the reference plane P constituting the median longitudinal plane of the shoe. It also has a second component of forward inclination $\alpha 1$ with respect to the plane P1, perpendicular to P, and which constitutes the reference plane in which the leg fits substantially in the unbent position (FIG. 1A).

Figure 2:
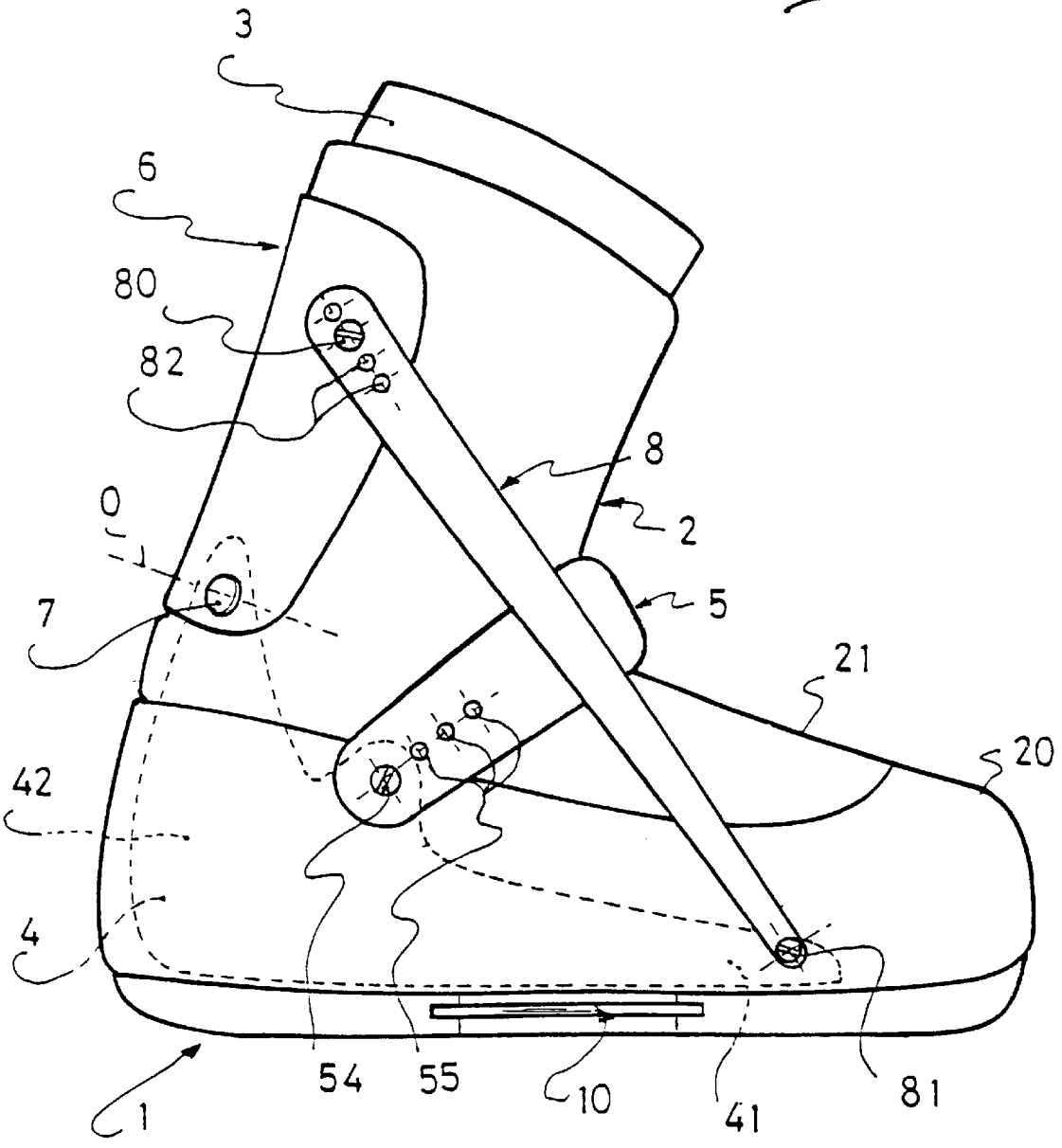
FIG. 2 is a view of the internal side of a snowboard boot according to the invention.

FIG. 2 shows a first embodiment of the "flexible"-type boot according to the invention which is the object of the following detailed description: in a manner known in itself, the boot has an external sole 1, adapted for walking, made of a wear-resistant material such as rubber, for example. The sole includes an anchoring member 10 adapted to cooperate with a complementary latching member (not shown) affixed to the board to form, together, a device for retaining the boot on the board. In the example of FIG. 2, the anchoring member is presented as a pin substantially oriented longitudinally on the side of the sole. For more details regarding the retaining device, reference is made to the non-published French application No. 95 06169 owned by the applicant. Of course, the anchoring member can be presented differently and can be located in an different area with respect to the sole, as in the examples shown in WO 95 26365.

The boot includes, on the outside, a flexible upper that is connected to the sole 1 and can be formed of different portions made of various materials all of which have a certain flexibility. In the example shown, the upper 2 is formed of a thin and impervious lower portion 20 made of rubber, for example, glued or riveted to the external outsole 1, and of an upper portion 21 made of fabric or leather, preferably sewn directly on the lower portion 20.

Of course, the upper can also have a tongue and one or more laces not shown.

A padded internal liner 3 that can rise more or less high on the calf and extend beyond the upper for a better comfort, as shown in FIG. 2, is inserted within the upper forming the external portion of the boot. It is made of natural or synthetic textile material, of leather, and perhaps padded with a flexible foam, for example.

A rigid internal shell 4 is arranged between the external portion formed by the sole 1 and the upper 2, and the internal portion constituted by the liner 3. This shell includes a base 40 shaped like a sole which extends from the heel up to the inclined limit of the metatarsus. It is important that the insert does not extend further toward the front, so as not to stiffen the front of the foot by rendering walking difficult. This base can advantageously replace the insole in the construction of the upper, for example. The shell has a rigidity that must be greater than the rigidity of the upper 2 in particular. It is preferably made of a reinforced or non-reinforced injected plastic material. Among the plastic materials that are suitable, one can cite polyurethanes, polyamides, ABS (Acrylonitrile-butadiene-styrene), polypropylenes, etc. The thickness of the shell is preferably comprised between 1 and 5 mm.

Figure 3:
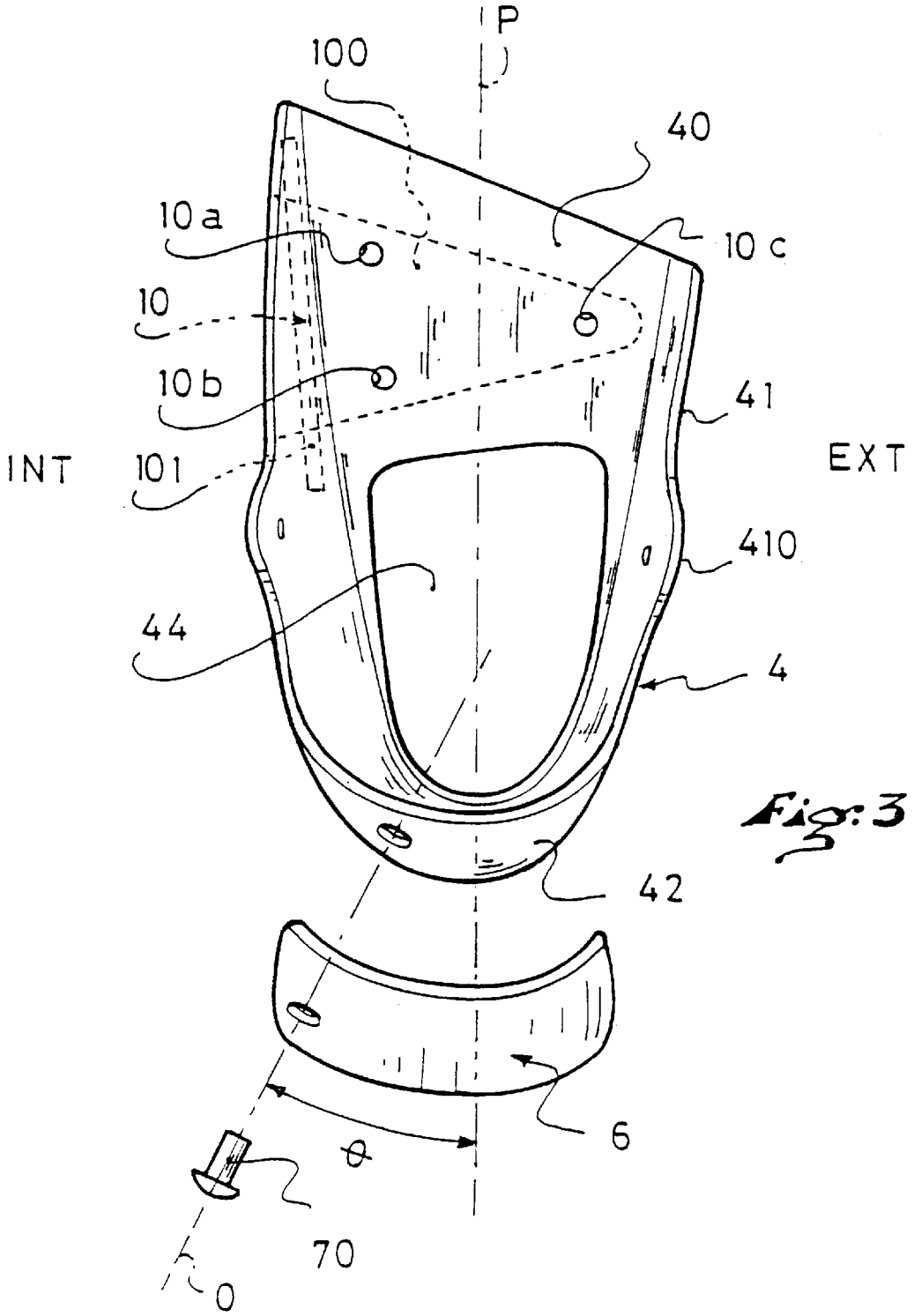
FIG. 3 is an exploded top view of the rigid shell, with the back portion adapted to be journalled thereon.
Figure 4:
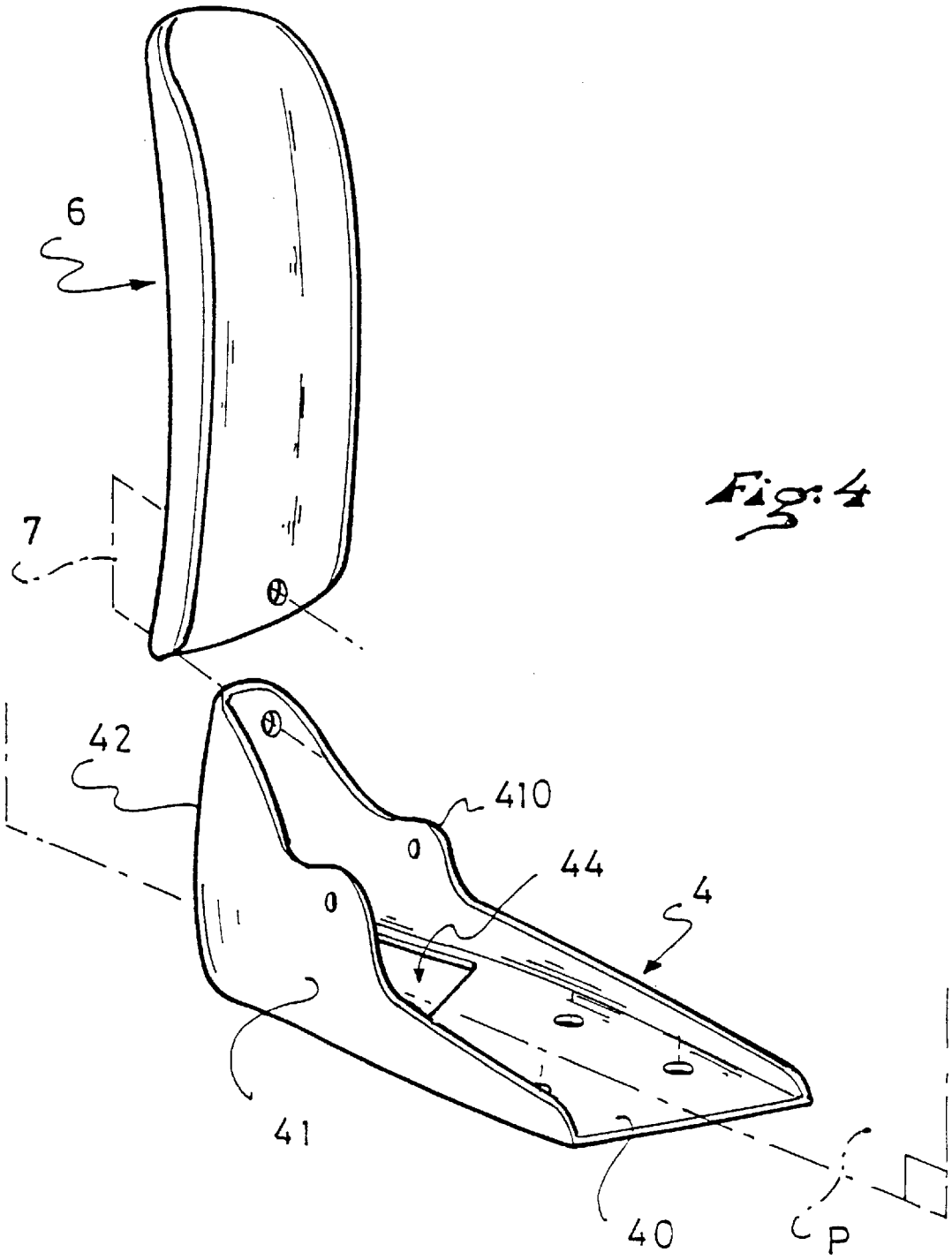
FIG. 4 is an exploded perspective view of the rigid shell, with the back portion adapted to be journalled thereon.

Lateral edges 41 extend upwardly from the base 40 of the shell, as shown more clearly in FIGS. 3 and 4. These edges participate in the wedging of the foot within the shell, and thus improve the transmission of forces with the board. The edges are extended by two lateral lugs 410 on which a strap for tightening the instep 5, arranged outside of the upper 2, is fixed.

In its rear portion 42, the shell 4 extends upwardly and has, at the level of the heel, a rounded and enveloping shape adapted to the heel morphology.

A rigid back portion 6 is journalled directly on the rear portion 42 of the shell, about an axis O inclined with respect to the median longitudinal plane P of the boot. The rigid back portion covers a portion of the shell and extends beneath the journal 7 to form a rigid rear support that is necessary for taking the so-called "back side turns". The back portion surrounds the calf, at least partially. Its rigidity is greater than the rigidity of the upper 2. It can be made of the same material as the shell. Preferably, it will be manufactured by thermoforming or by injection. In the example of FIG. 2, the back portion is located outside of the boot, against the flexible external upper 2. In this case, the journal merely extend through the upper. This construction has the advantage of facilitating the operations for mounting the boot. Thus, the back portion can merely be fixed at the end of a chain. The adjustment of the back portion is likewise facilitated.

The rear portion 42 of the shell must have a sufficient rigidity in compression in the substantially vertical direction because the rear support forces, during the "back side" turns, are transformed into compression forces on the rear portion 42 in view of the linkage between the shell and the back portion.

The boot according to the embodiment shown is also provided with a traction resisting means connecting the back portion 6 and the shell 4. This means is constituted by a single guy 8 passing on the internal side of the boot. The upper end of the guy is fixed directly on the internal side of the back portion by means of an appropriate attachment device 80. The lower end is fixed through the upper at the front of the shell 4, preferably by means of an irremovable means 81 of the rivet type or the like. To allow for an adjustment of the inclination of the back portion, the guy is provided with a length adjustment means, such as a series of openings 82 provided at the upper end, for example. The guy is thus located outside of the boot in the preferred embodiment. As a result, it becomes easier to make length adjustments without taking it off the shoe. The main function of the guy is to provide tensile strength during the external lateral supports exerted on the back portion, in the skating phase for example.

Of course, the boot can also be provided with two lateral guys, one on the external side, the other on the internal side of the boot, to ensure a more balanced tractional maintenance, if necessary.

As shown in FIG. 3, the back portion is journalled on the interior side (INT) of the boot about an axis O that forms an angle of inclination θ with respect to the median longitudinal plane P. According to the invention, this angle must be necessarily comprised between 20 and 45°.

Below 20°, the lateral bending component is promoted to the prejudice of the forward bending component, which is not the desired object. In addition, since the joint is located in the vicinity of the Achilles tendon, the rear supports can cause some pain due to the pressure of the back portion beneath the journal 7.

Beyond 45°, it is the forward bending component which, on the contrary, is promoted whereas the rigidity, in particular at the level of the journal, renders the lateral bending difficult, even impossible.

The back portion 6 is connected to the shell 4 at the level of the journal by any appropriate pivot attachment that allows it to rotate freely about the axis O. Preferably, one will use a rivet or an elastic clipping member 70.

As shown in FIGS. 3 and 4, the rounded shape of the back portion is anatomical so as to fit the calf portion for an optimum comfort.

The shell and the back rigid portion have complementary shapes in the covering zone so as to limit the thickness. Since the journal is offset, it to be understood that this shape complementarity will promote the bending toward the interior (INT) of the boot, whereas it will produce blockage points during a bending toward the exterior (EXT) from a certain inclination threshold. The outward retention of the leg is advantageous, especially in the rebound phases, when the other leg is separated from the board and serves to push the latter forward.

Still in an advantageous manner, the flexional rigidity of the shell decreases progressively, at least from the median zone up to its front end. The unrolling movement of the front portion of the foot at the level of the metatarsus joint during walking is thus facilitated. Different means can be envisioned to obtain this characteristic. As shown in FIG. 4, the lateral edges 41 have a height that decreases progressively toward the front. Finally, for a comparable result, the base 40 can comprise localized weakening zones or have a thickness that decreases progressively toward the front.

As shown in FIGS. 3 and 4, the base 40 of the shell can advantageously include a recess 44 in the heel area. This recess can be filled with a flexible material, preferably a shock absorbing foam, for example. Thus, the walking comfort is promoted when the heel strikes the ground.

As shown along the dotted line in FIG. 3, the anchoring means 10 of the boot, which has an anchoring plate 100 and a lateral pin 101 that is affixed thereto and adapted to cooperate with a latching means fixed to the board, is directly connected to the shell 4 at least at three fixed points 10*a*, 10*b*, 10*c*. Such a construction allows for a better transmission of forces and supports through the energy circuit thus created.

Figure 5:
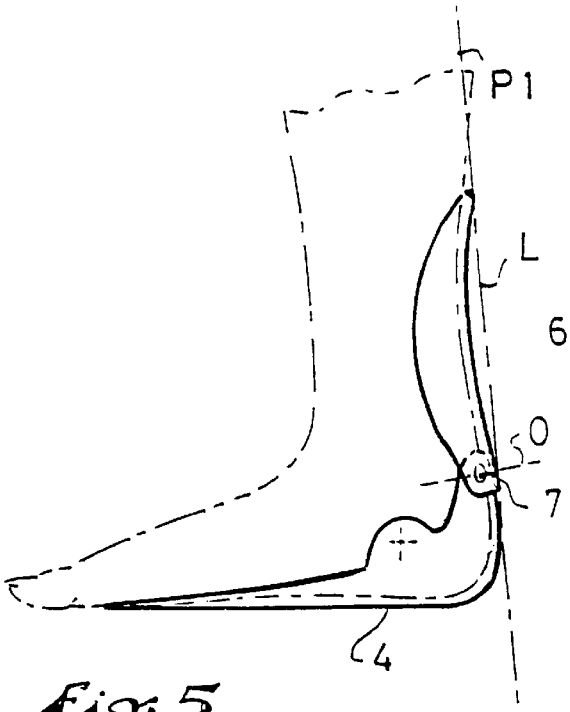
FIG. 5 schematically shows, in a side view, the journalled shoe portion in the standing position of the surfer.
Figure 7:
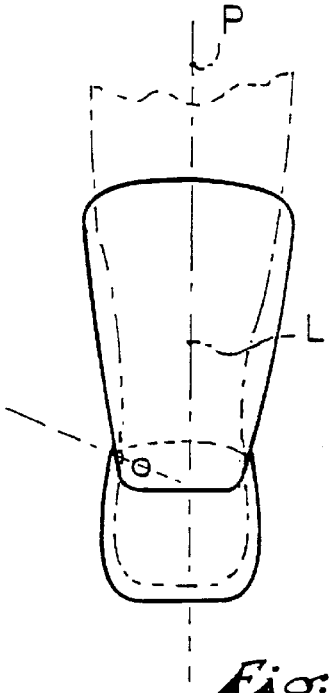
FIG. 7 is similar to FIG. 5, but in a rear view.
Figure 6:
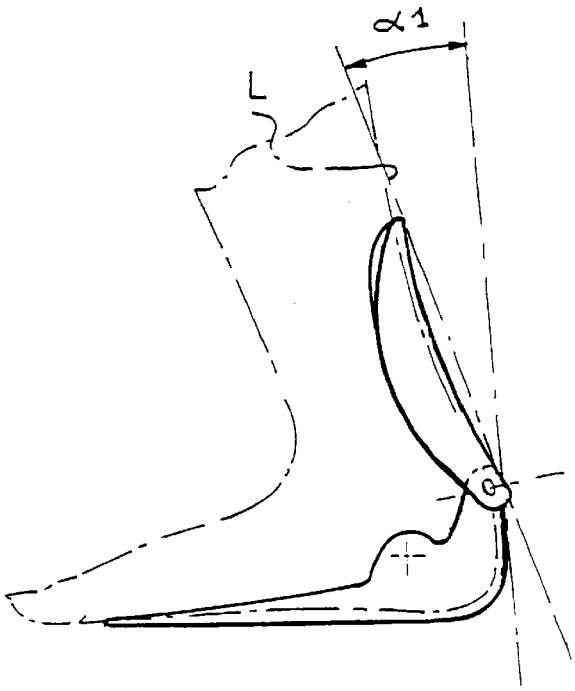
FIG. 6 schematically shows, in a side view, the journalled shoe portion during the natural inward bending of the leg.
Figure 8:
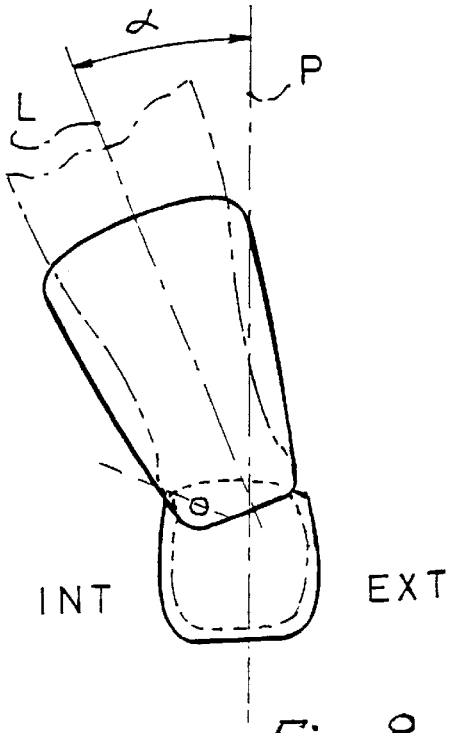
FIG. 8 is similar to FIG. 6, but in a rear view.

FIGS. 5–8 show the kinematics of the rigid and journalled assembly formed by the shell 4 and the back portion 6. Before the bending, the reference line L represents the intersection of the median longitudinal plane P and of the reference plane P1 (FIGS. 5 and 7). This line L is forwardly displaced along an angle α1 with respect to the plane P1 during the flexional natural movement of the lower leg (FIG. 6). At the same time, the line L is displaced along an angle α toward the interior (INT) with respect to the plane P (FIG. 8).

Figure 9:
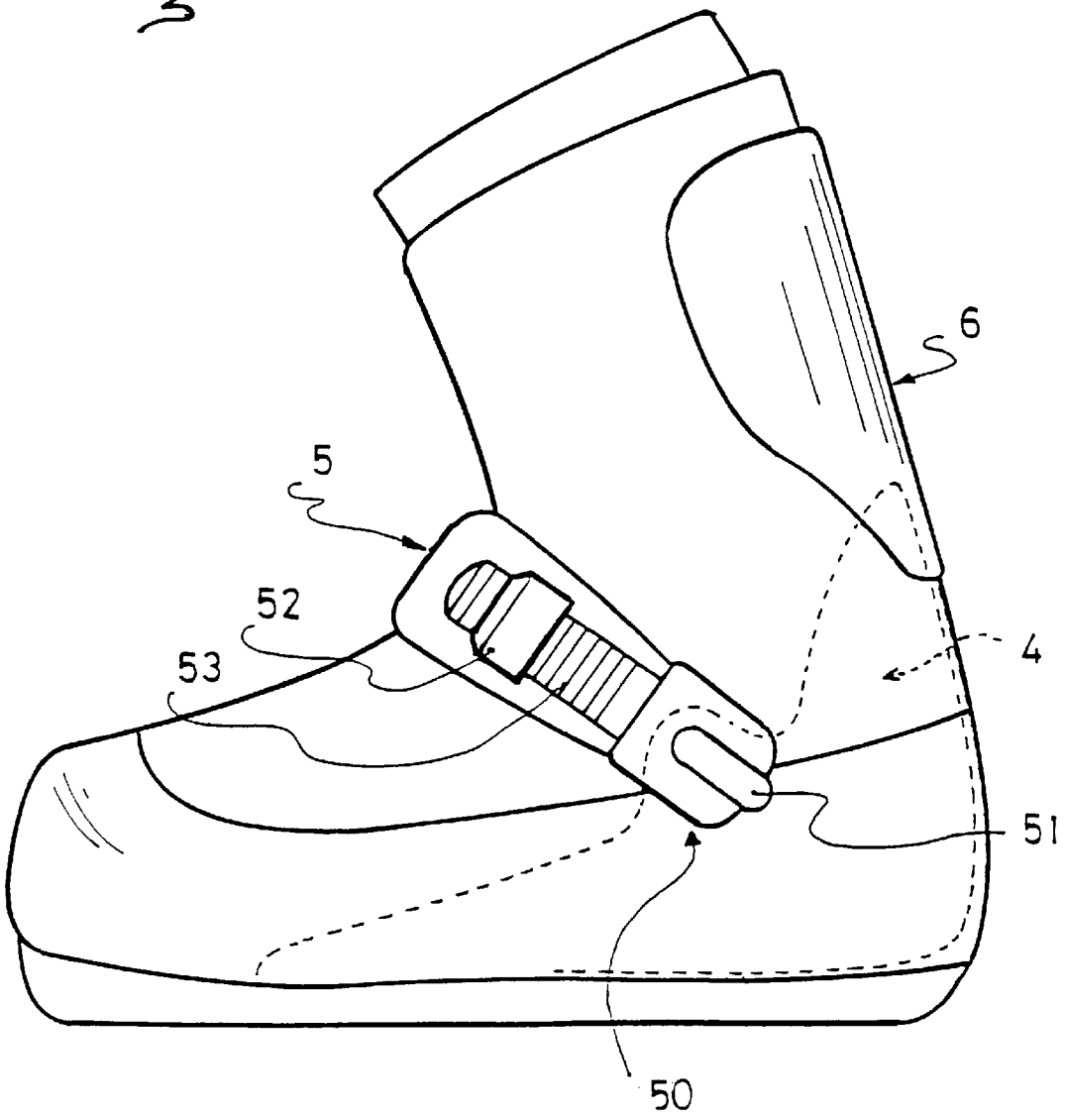
FIG. 9 is a view of the external side of the boot of FIG. 2.

FIG. 9 shows the external view of the boot according to the preceding embodiment that shows only one of the sides of the strap and which includes, in particular, a tensioning mechanism 50, known in itself and formed by a buckle 51 and a catch 52 in which a notched strap 53 slides for tightening the instep of the foot.

Of course, other adjustable or non-adjustable tensioning systems could also be used.

On the other side of the boot, the tightening strap 5 is fixed on the edge of the shell through the upper by means of a preferably removable attachment means 54.

A series of openings 55 are arranged along the end of the strap constituting an adjustment mechanism for adjusting an adjusting the length of the strap (FIG. 2).

Figure 10:
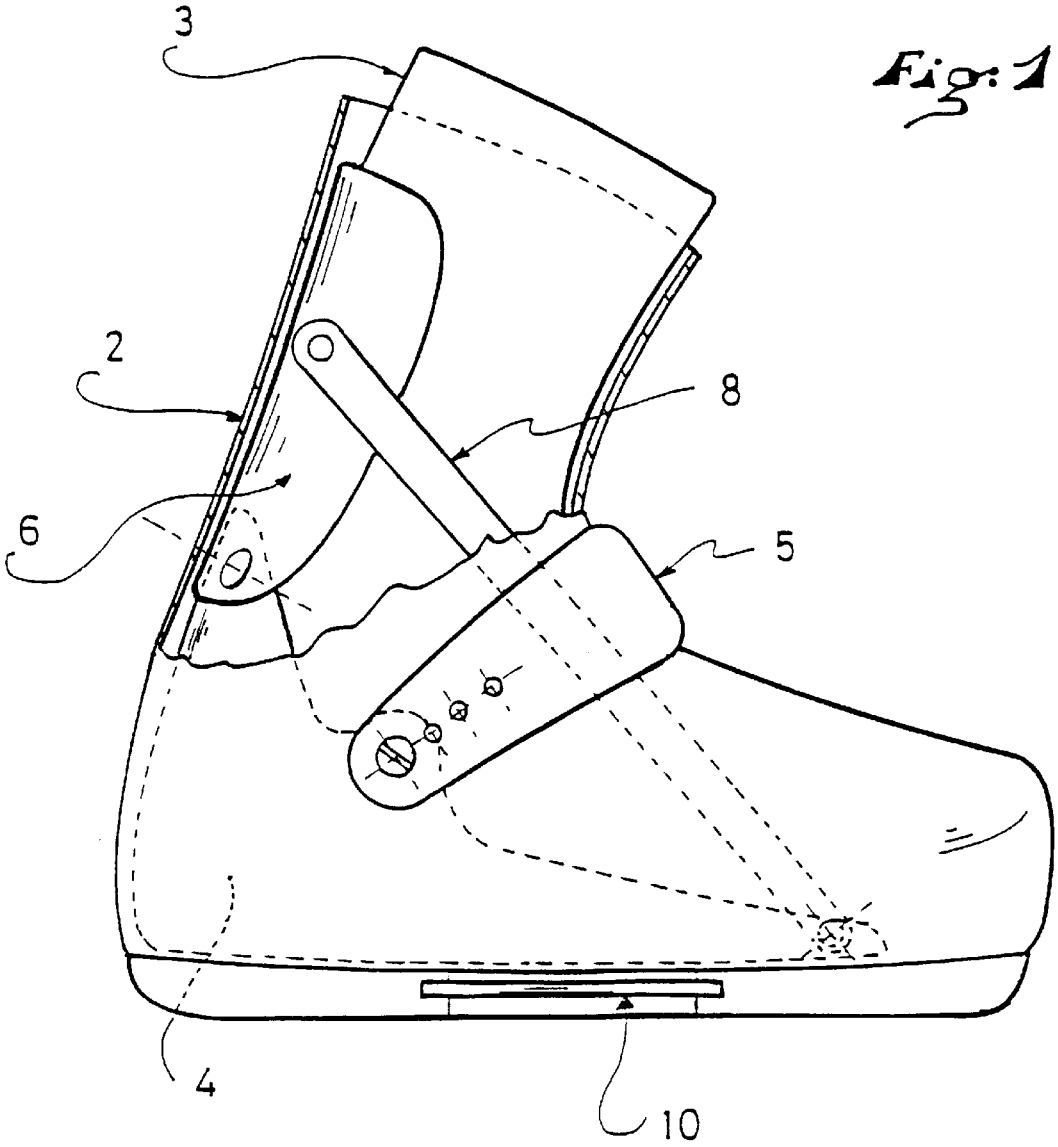
FIG. 10 is a variation of FIG. 9.

As shown in the variation of FIG. 10, the back portion can also be inserted within the boot, between the external upper 2 and the liner 3, for example. In this case, the linkage guy 8 between the back portion and the shell is also external. The back portion could also be integrated into the construction and enclosed in a pocket formed by a plurality of folds or thicknesses of the external upper sewn to one another, for example. In any case, the journal between the back portion and the shell will be obtain in the same manner and will cross the intermediate separation folds.

The external outsole can be overmolded, glued, or merely positioned so as to allow the latching means to be apparent.

Of course, the shell can integrate a plurality of anchoring means allowing for a linkage of the boot on the board at several points.

It is to be understood that the examples of construction described and illustrated merely constitute preferred non-limiting embodiments, and that the scope of the following claims also extends to other constructions encompassing any equivalent means.

The instant application is based upon French patent application No. 95.08587, filed on Jul. 11, 1995, the disclosure of which is hereby expressly incorporated by reference thereto, and the priority of which is hereby claimed under 35 USC §119.

Finally, although the invention has been described with reference of particular means, materials and embodiments, it is to be understood that the invention is not limited to the particulars disclosed and extends to all equivalents within the scope of the claims.

What is claimed is:

1. A snowboard boot comprising:

a sole having a structure adapted for being affixed to a snowboard;

an upper connected to said sole, said upper comprising at least one flexible material, said upper having a portion forming an outer surface of the boot;

a shell at least partially covering said sole, said shell having a front portion and a rear portion, said rear portion extending upwardly at a heel area of the boot, said shell being made of a rigid material;

a back portion comprising a rigid material, said back portion extending upwardly from said rear portion of said shell; and a journal attachment journalling said back portion to said rear portion of said shell, said journal attachment being positioned on a medial side of the boot, along a journal axis forming an angle of between 20° and 45° with respect to a longitudinal median plane of the boot.

2. A snowboard boot according to claim 1, wherein:

said angle between said journal axis and said longitudinal median plane is between 25° and 35°.

3. A snowboard boot according to claim 1, wherein:

said angle between said journal axis and said longitudinal median plane is close to 30°.

4. A snowboard boot according to claim 1, wherein:

said journal axis is inclined form rear to front and from top to bottom.

5. A snowboard boot according to claim 1, wherein:

said back portion covers a portion of said shell and extends beneath said journal attachment to form a rigid rear support.

6. A snowboard boot according to claim 5, wherein:

said back portion is positioned against said outer surface of the boot formed by said flexible material of said upper, said back portion thereby being located on an outside of the boot; and said journal attachment extending through said upper.

7. A snowboard boot according to claim 1, wherein:

said shell includes a base at least partially covering said sole and a spaced pair of lateral edges extending from said base, said edges being adapted to secure the boot on each lateral side.

8. A snowboard boot according to claim 7, further comprising:

a tightening device, said tightening device comprising a strap connecting each of said lateral edges of said shell, said strap having a length adapted for extending over an instep of a foot inserted within the boot.

9. A snowboard boot according to claim 8, wherein:

said tightening device further comprises a tensioning mechanism and at least one mechanism to adjust an effective length of said strap.

10. A snowboard boot according to claim 1, further comprising:

a single traction-resistant guy positioned on a median side of the boot, said guy connecting said back portion to said front portion of said shell.

11. A snowboard boot according to claim 1, wherein:

said shell extends from an area corresponding to a heel of a user's foot, forwardly no greater than an area corresponding to an end of a metatarsus of a user's foot.

12. A snowboard boot according to claim 11, wherein:

said shell comprises a structure having a flexional rigidity gradually decreasing forwardly from at least a center of said shell to a front end of said front portion of said shell.

13. A snowboard boot according to claim 1, wherein:

said rear portion of said shell has a rounded and heel-enveloping shape adapted to a heel morphology.

14. A snowboard boot comprising:

a heel member;

a leg member positioned above the heel member;

wherein the heel member is pivotally attached to the leg member at a pivot location so that the leg member is capable of movement relative to the heel member about an axis of rotation that passes through the pivot location;

wherein the axis of rotation is inclined from rear to front and from top to bottom;

wherein the pivot location is offset from the longitudinal median plane; and wherein the axis of rotation forms an angle with the longitudinal median plane.

15. A snowboard boot comprising:

a shell having a rear portion;

a rigid back portion positioned above the rear portion of the shell;

wherein the rear portion of the shell is pivotally attached to the rigid back portion at a journal axis so that the rigid back portion is capable of movement relative to the rear portion of the shell about an axis of rotation that passes through the journal axis;

wherein the axis of rotation is inclined from rear to front and from top to bottom;

wherein the journal axis is offset from a longitudinal median plane; and wherein the axis of rotation forms and angle with the longitudinal median plane.

* * * * *